United States Patent [19]

Gregory et al.

[11] 4,176,973

[45] Dec. 4, 1979

[54] STENOTYPE TAPE MARKING ATTACHMENT

[76] Inventors: Stephen A. Gregory, 13532 Wynant Dr., Westminster, Calif. 92683; Joseph A. Welzen, 11338 Barbi La., Los Alamitos, Calif. 90720

[21] Appl. No.: 820,256

[22] Filed: Jul. 29, 1977

[51] Int. Cl.[2] ..... B41J 3/26; B41J 29/00

[52] U.S. Cl. ..... 400/91; 400/706

[58] Field of Search ..... 197/9, 180, 187; 178/21; 400/91-94, 703, 706, 709

[56] References Cited

U.S. PATENT DOCUMENTS

| | | | |
|---|---|---|---|
| 1,732,017 | 10/1929 | Jenkins | 101/327 X |
| 2,823,784 | 2/1958 | Ambrose | 197/9 |
| 2,847,104 | 8/1958 | Segui | 197/9 |
| 3,213,995 | 10/1965 | Applin | 197/9 X |
| 3,756,153 | 9/1973 | Cohen | 101/368 |
| 4,024,943 | 5/1977 | Steiner | 197/9 X |

*Primary Examiner*—Paul T. Sewell

[57] ABSTRACT

A tape marking attachment for a stenotype machine. The marking attachment has a mounting base to be fixed tothe machine frame and at least one marking pad resiliently mounted on the base, as by a hinged spring arm, for depressing into marking engagement with the machine tape to mark selected portions of the tape for subsequent reference. The described marking attachment has a pair of independently depressable marking pads disposed for marking engagement with opposite edges of the machine tape.

21 Claims, 9 Drawing Figures

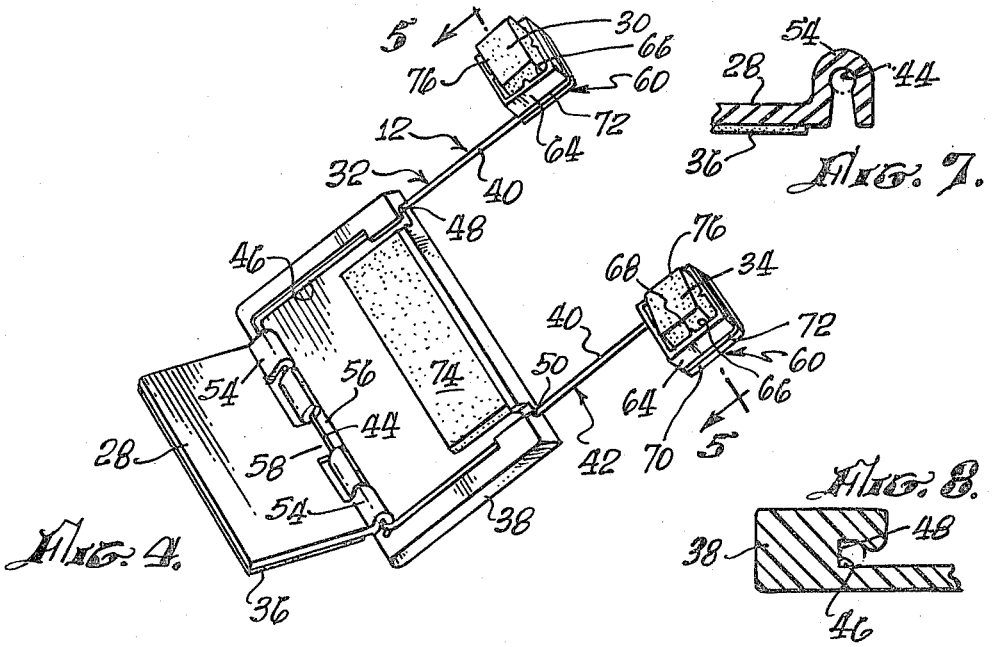
5
30
66
76
60
72
64
12
32
40
48
46
54
56
74
44
58
28
36
38
50
42
70
34
68
FIG. 4.
54
28
44
36
FIG. 7.
48
38
46
FIG. 8.
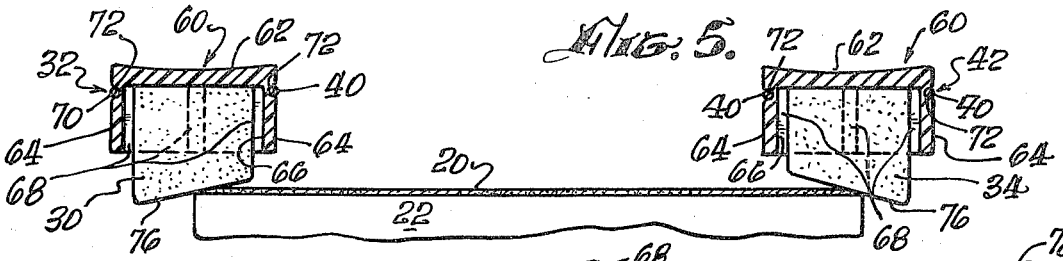
72
60
62
32
40
70
64
68
66
30
76
20
22
42
34
FIG. 5.
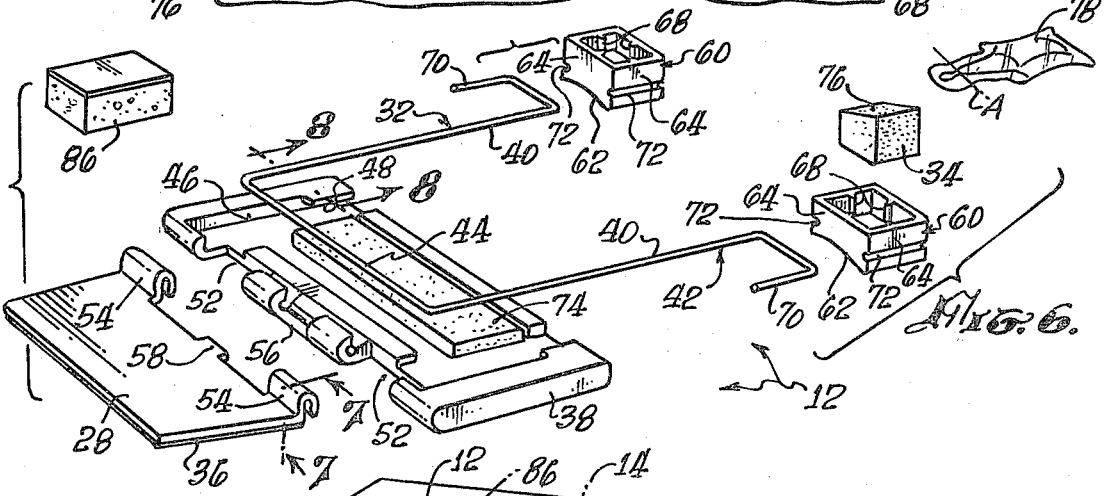
86
8
46
48
44
52
54
58
56
28
36
7
38
70
64
60
72
62
32
40
76
34
68
42
12
78
A
FIG. 6.
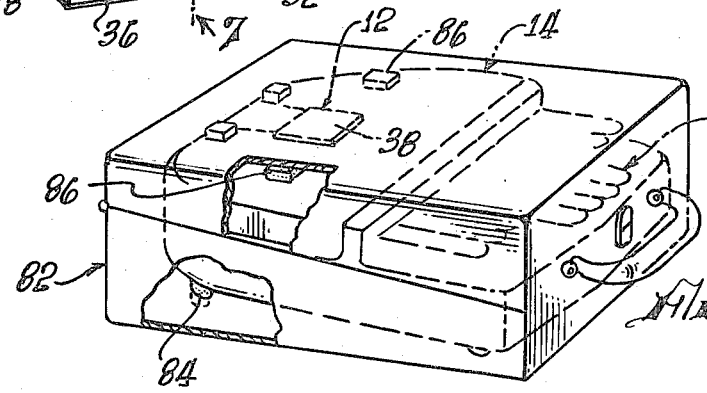
12
86
14
38
16
82
84
FIG. 9.

STENOTYPE TAPE MARKING ATTACHMENT

BACKGROUND OF THE INVENTION

1. Field of the Invention

This invention relates generally to stenotype machines and more particularly to a novel tape marking attachment for such machines.

2. Prior Art

Stenotype machines are widely used for recording legal testimony, office dictation, and other recording applications. As is well known to those versed in the art, a conventional stenotype machine has a frame or housing mounting along its front side a series of keys resembling typewriter keys. At the rear side of the machine is an imprinting zone through which a paper tape is progressively fed, in response to depression of the keys, from a tape supply within the housing. Depression of the keys also imprints the tape, within the imprinting zone, with shorthand symbols which are so designed that a skilled stenotype operator may accurately record and subsequently transcribe testimony, dictation, and the like at a relatively high rate of speed.

This invention is concerned with one particular problem which is frequently encountered in the use of a stenotype machine. The problem referred to resides in the fact that the machine operator often finds it desirable to mark selected portions of the tape for later reference and/or ease of location. At the present time, it is common practice to mark the tape by paper clips, folds, pencil marks, or the like. These methods of marking the tape, however, are not satisfactory for the reason that they interfere with operation of the stenotype machine, slow the recording procedure, result in incomplete or inaccurate stenotype recordings, and creates severe strain in the stenotype operator.

Stenotype tape marking devices have been devised in an attempt to avoid the above noted and other disadvantages inherent in the described tape marking procedure. One of these marking devices, for example, fits on a stenotype machine adjacent the rear tape imprinting zone of the machine and is selectively operable by the machine user to imprint a mark on the edge of the machine tape.

SUMMARY OF THE INVENTION

This invention provides an improved tape marking device for a stenotype machine. The improved marking device of the invention comprises an attachment having a mounting base to be fixed to the top side of the machine frame or housing adjacent its rear imprinting zone. Supported on this mounting base for resilient depression into marking engagement with the portion of the stenotype machine tape within the imprinting zone is at least one marking pad. According to the preferred practice of the invention, the marking attachment is equipped with a pair of marking pads which are selectively depressable into marking engagement with opposite edges of the tape. The mark produced by each pad has a distinctive characteristic, such as color.

One important feature of the invention is concerned with the manner in which the marking pads are resiliently mounted for depression into marking engagement with the stenotype tape. In the preferred embodiment of the invention described, each marking pad is attached to the outer end of a spring arm, the inner end of which is fixed to a hinge plate. This hinge plate is pivotally mounted along its rear edge to the mounting base, which is also a plate. In the normal position of the mounting attachment, the upper hinge plate is supported on the mounting plate, preferably through an intermediate foam cushioning pad, with each marking pad located over an edge of the machine tape. Finger pressure applied to the marking pad depresses the pad downwardly into marking engagement with the underlying tape. During this depression of the marking pad, its spring mounting arm is deflected downwardly to create in the arm elastic strain energy which returns the pad upwardly to its normal upper position out of contact with the tape when the finger pressure is removed from the marking pad.

This preferred tape marking attachment of the invention has a pair of marking pads for marking opposite edges of the machine tape. The spring arms for these pads comprises the two ends of a wire which is bent into a U-shape and secured at its closed end to the hinged plate of the attachment. The transverse connecting portion of this wire forms a hinge pin for pivotally connecting the hinge plate to the mounting plate. The hinge plate, marking pads, and the spring wire are rotatable, about this hinge pin, to a retracted position, wherein the pads clear the imprinting zone of the machine for ease of removal and insertion of the tape from and into the machine.

Another feature of the invention is concerned with the construction of the marking pads themselves. According to the preferred practice of the invention, these pads comprise porous members, such as microporous plastic blocks, whose pores are filled with ink. The tape engaging surfaces of these pads are inclined relative to the plane of the tape in such a way as to insure marking of the tape by the pads. According to another feature of the invention, the tape engaging surfaces of these pads are partially coated with an ink impervious layer. This provides each marking pad with a relatively large void volume for containing ink and a relatively small effective surface area for marking engagement with the tape so as to maximize the number of imprints each marking pad may make. When depleted of ink, each marking pad may be either replaced in its entirety or may be recharged with ink.

BRIEF DESCRIPTION OF THE DRAWINGS

FIG. 4 is a perspective view of the marking attachment per se;

FIG. 5 is an enlarged fragmentary view illustrating the manner of engagement of the attachment marking pad with the stenotype tape;

FIG. 6 is an exploded perspective view of the marking attachment;

FIG. 7 is an enlarged section taken on line 7—7 in FIG. 6;

FIG. 8 is an enlarged section taken on line 8—8 in FIG. 6; and

FIG. 9 is a perspective view illustrating containment of the stenotype machine and its marking attachment within a carrying case.

DESCRIPTION OF THE PREFERRED EMBODIMENT

Figure 1:
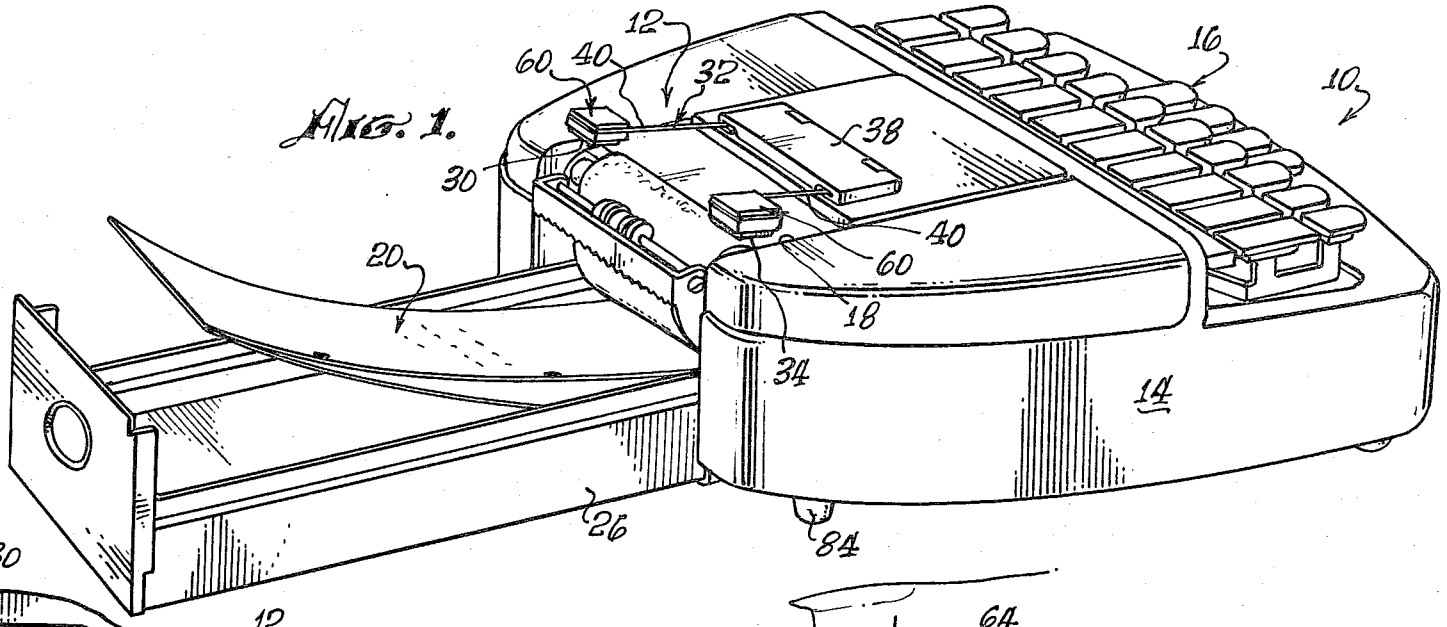
FIG. 1 is a perspective view of a stenotype machine equipped with a tape marking attachment according to the invention.
Figure 3:
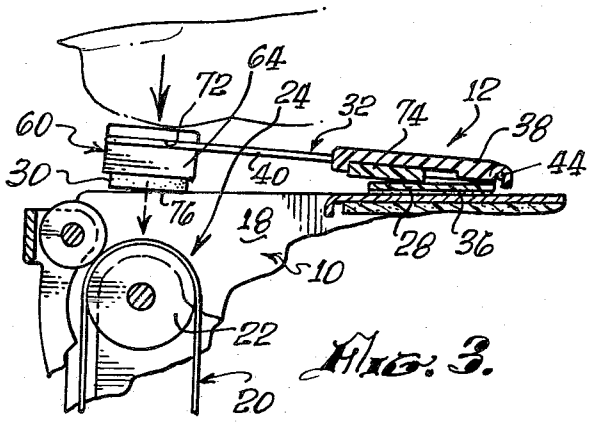
FIG. 3 is a section taken on line 3—3 in FIG. 2 illustrating the marking operation of the attachment.
Figure 2:
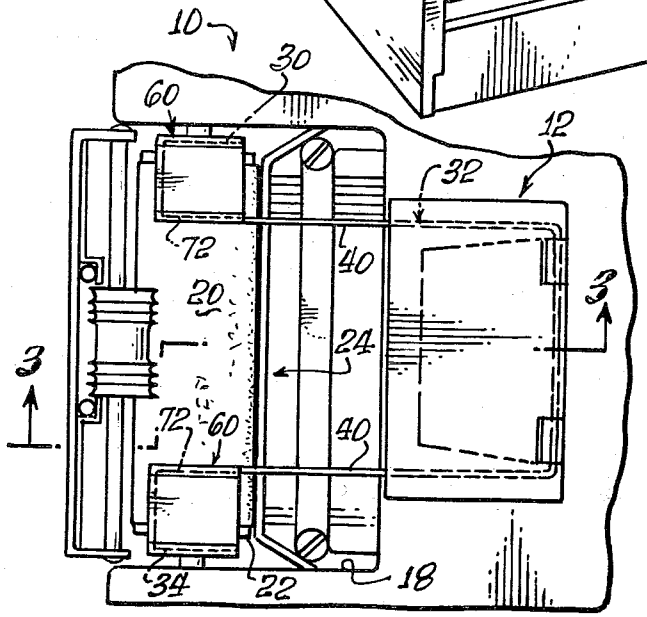
FIG. 2 is an enlarged top plan view of the marking attachment.

Referring first to FIGS. 1 through 3, there is illustrated a conventional stenotype machine 10 equipped with a marking attachment 12 according to the invention. The stenotype machine 10 is conventional and hence need not be described in elaborate detail. Suffice it to say that the machine has a frame or housing 14 containing the major mechanism of the machine. Along the front side of this housing are keys 16 resembling typewriter keys. At the rear of the housing is a slot-like opening 18 through which is exposed the paper tape 20 of the machine. This tape passes over a roller 22 located within the opening 18, adjacent the top side of the housing 14, and within the tape imprinting zone 24 of the machine. At the rear of the housing 14 is a drawer 26 which is slidable rearwardly from the housing to its open position of FIG. 1.

Depression of the stenotype keys 16 effects intermittent feeding of the paper tape 20 from a tape supply (not shown) within the housing, through the imprinting zone 24 and about the roller 22, into the drawer 26. The tape is creased in such a way that it folds accordion fashion as it enters the drawer. This depression of the stenotype keys 16 also actuates imprinting means (not shown) which imprints stenotype symbols on the tape 20 within the imprinting zone 24. These stenotype symbols are so selected that a skilled stenotype machine operator may record and transcribe dictation, testimony, and the like at a relatively high rate of speed.

The stenotype tape marking attachment 12 constitutes the primary contribution to this invention. This marking attachment is adapted for quick and easy actuation by the machine operator to place a reference mark at any selected position along either edge of the tape 20 for indicating and/or aiding the machine operator in subsequently locating selected portions of the stenotype recording on the tape.

Referring particularly to FIGS. 4 through 8, the marking attachment 12 comprises a mounting base 28 to be fixed to the stenotype machine housing 14 adjacent the tape imprinting zone 24 of the machine, at least one marking pad 30, and resilient arm means 32 resiliently and swingably mounting the pad on the base for movement, by finger pressure, between a normal retracted position shown in FIG. 3 and in extended tape marking position shown in FIG. 5. In its normal retracted position, the marking pad 30 is located directly over and in spaced relation to the tape roller 22, as shown in FIG. 3. The marking pad is depressable downwardly to its marking position of FIG. 5 by downward finger pressure on the pad, as indicated in broken lines in FIG. 3. In this marking position, the marking pad engages one edge of the tape on the roller 22 in the manner shown in FIG. 5 to apply a mark to the tape edge. When the finger pressure is removed from the marking pad, the latter is returned to its normal position of FIG. 3 by elastic strain energy.

It will become evident from the ensuing description that the marking attachment 12 of the invention may embody but a single marking pad. On the other hand, the preferred embodiment illustrated has a pair of marking pads, namely the marking pad 30 and a second marking pad 34. Both of these marking pads are resiliently and swingably mounted on the attachment mounting base 28 by the resilient arm means 32 for independent movement of the pads between their retracted and marking positions. As shown best in FIGS. 1, 2 and 5, the two marking pads 30, 34, are aligned with the two longitudinal edges, respectively, of the stenotype tape. Accordingly, one pad is operable to mark one edge of the tape and the other pad is operable to mark the opposite edge of the tape. The mark applied to the tape by each marking pad may have a distinguishing characteristic, such as color. In the particular marking attachment illustrated, for example, the marking pad 30 applies a red mark to the tape 20 and the marking pad 34 applies a green mark to the tape.

Referring now more in detail to the drawings, the mounting base 28 of the marking attachment 12 comprises a rectangular plate which is secured to the top side of the stenotype machine housing 14 along the front edge of the housing opening 18, in the manner best illustrated in FIGS. 1 and 2. Attachment of the mounting plates to the machine housing may be accomplished in any convenient way. According to the preferred practice of the invention, the under side of the mounting plate bears a pressure sensitive adhesive layer 36 for adhesively bonding the plate to the housing.

The resilient arm means 32 for swingably mounting the marking pads 30, 34, on the mounting plate 28 comprises a rectangular hinge plate 38 which is pivotally joined along one longitudinal edge to the normally front edge of the base plate, in the manner hereinafter explained. Secured to the hinge plate 38 and extending edgewise of the latter beyond its opposite edge are a pair of spring arms 40 which mounting the marking pads 30, 34. In the particular embodiment illustrated, the spring arms 40 comprise opposite ends of a spring wire 42 which is bent into a U-shape and includes a transverse connecting portion 44 extending between and integrally joining the inner ends of the spring arms 40. This closed U end of the wire 42 is disposed within and fits closely within a generally rectangular recess 46 entering the normally under side of the hinge plate 38. This recess opens edgewise of the hinge plate through its outer edge, that is the hinge plate edge opposite and parallel to its hinged edge. Along the three remaining sides or edges of the recess 46 are channels 48, 50 which open to the recess and receive, respectively, the spring wire arms 40 and connecting portion 44 of the wire 42, in the manner best illustrated in FIG. 4, for releasably securing the wire 42 to the hinge plate 38.

Along the inner, hinged edge of the hinge plate 38 are cutouts or notches 52 across which extend the inner transverse connecting portion 44 of the spring wire 42. Inwardly joined to and projecting from the normally forward edge of the mounting plate 28 are generally hook-shaped tabs 54 which fit within the cutouts 52 and about the connecting wire portion 44 to form with this wire portion a hinge connection between the base plate and the hinge plate 38. Thus, the connecting wire portion 44 effectively forms a hinge pin of the connection between the mounting plate and hinge plate.

Also along the inner edge of the hinge plate 38 is a center cutout or notch 56 which receives a center projecting tab 58 along the forward edge of the base plate 28. The purpose of this center base plate tab will be explained presently.

At the outer end of the spring arms 40 are marking pad holders 60. Each pad holder 60 comprises a hollow rectangular button-like member having a normally upper concave wall 62 of rectangular outline bounded along its four edges by depending side walls 64. The top wall 62 and side wall 64 of each pab holder 60 form a normally downwardly opening cavity 66 for receiving a marking pad 30, 34. Along the four sides of this cavity are inwardly projecting ribs 68 for frictionally engaging the marking pad to retain the latter in the cavity.

The outer ends of the spring arms 40 have U-bends 70 which encircle and seat within grooves 72 in three sides of the pad holders 60 to releasably secure the holders to the arms. The pad holders are secured to the spring arms in a manner such that in a normal position of the marking attachment 10 shown in FIGS. 1 and 3, the holders open downwardly, and the marking pads 30, 34 project below the holder. Also, as best shown in FIG. 5, the centers of the pad holders 60 are approximately aligned with the ends, respectively, of the tape roller 22. According to the preferred practice of the invention, the upper hinge plate 38 mounts a cushioning pad 74 of resilient foam material or the like for resiliently supporting the hinge plate in its normal position of FIG. 3 relative to the base plate 28.

The marking pads 30, 34 may comprise any suitable marking pads, such as porous ink pads of microporous plastic material or the like. According to the preferred practice of the invention, the lower, tape engaging surfaces 76 of the pads are beveled, as shown in FIG. 5, so that they slope upwardly in a lateral direction of and toward a vertical plane parallel to and midway between the spring arms 40. According to preferred practice of the invention, the tape engaging pad surfaces 76 may be partially covered by an ink impervious layer (not shown), such that each pad has a relatively large porous body portion containing ink in a relatively small taping engaging surface, thereby to maximize the number of impressions each marking pad may make before depletion of its ink supply. As noted earlier, the marking pads 30, 34 may be either replaceable or refillable upon depletion of their ink supplies. In this regard, attention is directed to FIG. 6 which illustrates a small plastic ink capsule 78 having a tip which is adapted to be cut along line A and inserted into the space between an ink pad 30, 34 and the wall of its holder 60 and then squeezed for injecting into the holder cavity 66 ink which is then absorbed by capillary action into the pores of the marking pad.

In use of the marking attachment 12, the latter is mounted on the frame or housing 14 of the stenotype machine 10 in the manner illustrated in the drawings wherein some comparable position depending upon the particular design of the stenotype machine. Normally, the marking pads 30, 34 are retained in their retracted positions of FIG. 3 out of contact with the stenotype tape 20. When the machine operator desires to mark the tape, he simply presses downwardly on the upper concave surface 62 of the holder 60 of either or both of the marking pads 30, 34 to depress the respective pad or pads into inking contact with the tape 20, as shown in FIG. 5. Owing to the sloping pad faces 76, the pads will first contact the tape at the outer tape edges, after which increasing pressure will result in increased surface are contact between the pads and the tape, thus to assure efficient marking of the tape. When the finger pressure is removed from the pad holder or holders, the latter will spring back to their retracted positions under the action of elastic strain energy.

At this point it is significant to note that the wire construction of the spring arms 40 permits the latter to be bent in order to properly locate the marking pads 30, 34 relative to the stenotype tape. Moreover, it will be understood that the spring arms are sufficiently spread apart prior to insertion of the spring wire 42 in the hinge plate 38 to assure firm retention of the arms in the plate channels 48, 50.

When removing a completed tape 20 from the stenotype machine 10 and refilling the machine with new tape, it is desirable to retract the marking structure of the marking attachment 12, that is the marking pads 30, 34, their holders 60, and supporting arm means 32, clear of the machine opening 18. This is accomplished by rotating the structure about its hinged connections to the mounting plate 28 to the retracted position illustrated in FIG. 4. The marking structure is retained in this position by engagement of a beveled surface bounding the hinge plate slot 56 with the tab 58 on the mounting plate 28. In this regard, it is to be noted that in the retracted position of the marking structure in FIG. 4, the structure inclines upwardly relative to the mounting plate 28 so as to facilitate return of the structure to its operative position of FIG. 1.

As shown in FIG. 9, a stenotype machine equipped with the present marking attachment 12 may be contained within the machine carrying case 82. If necessary, the rear supporting leg 84 of the machine may be shaved sufficiently to provide clearance for the attachment between the machine and the case. Additional holding pads 86 may be mounted on the inside of the case to hold the machine firmly in position.

The inventors claim:

1. A tape marking attachment for a stenotype machine comprising:

a mounting base for attachment to the machine, a marking pad, a resilient spring wire arm means carrying said marking pad spaced from the mounting base, and means hingedly supporting the resilient arm means on the base with the pad in an upward retracted position, said arm means comprising a resiliently flexible arm which bends in response to light manual downward pressure on said marking pad into an extended downward marking position.

2. The marking attachment according to claim 1, wherein:

said arm means further comprises a hinge plate secured to said flexible arm and pivotally attached to said mounting base, said hinge plate, flexible arm, and marking pad comprise a marking structure which is rotatable as a unit relative to said mounting base between a normal operative position and an inoperative position, and said marking pad is movable relative to said hinge plate between said normal retracted position and extended marking position by bending of said flexible arm in said operative position of said marking structure.

3. The marking attachment according to claim 2 wherein:

said mounting base comprises a mounting plate for attachment to said machine, said hinge plate overlies said mounting plate in said operative position of said marking structure, and resilient cushioning means mounted on one of said plates and engageable with the other plate to support said marking structure in said operative position relative to said mounting plate.

4. The marking attachment according to claim 1 wherein:

said arm means comprises a resiliently flexible arm which bends to accommodate movement of said marking pad between said normal retracted position and said extended marking position, said marking attachment comprises a hollow holder secured to one end of said arm and containing a normally downwardly opening cavity receiving said marking pad with the latter projecting below said holder for contact with a stenotype tape, and said holder has a normally upper surface against which light downward finger pressure may be exerted to depress said holder and marking pad from said normal retracted position to said extended marking position.

5. A tape marking attachment for a stenotype machine comprising:

a mounting base for attachment to the machine, a marking pad, a resilient arm means carrying said marking pad spaced from the mounting base, means hingedly supporting the resilient arm means on the base with the pad in an upward retracted position, said arm means comprising a resiliently flexible arm which bends in response to manual downward pressure on said marking pad into an extended downward marking position, a hollow holder secured to one end of said arm and containing a normally downwardly opening cavity receiving said marking pad with the latter projecting below said holder for contact with a stenotype tape, said arm comprising a wire having a bend at said one end encircling said holder to secure the latter to said arm, and said holder having a normally upper surface against which finger pressure may be exerted to depress said holder and marking pad from said normal retracted position to said extended marking position.

6. The marking attachment according to claim 4 wherein:

said marking pad comprises a porous pad, and a space exists between said marking pad and said holder into which a marking fluid may be injected for absorption into the pores of said pad.

7. A tape marking attachment for a stenotype machine comprising:

a mounting base for attachment to the machine, a pair of marking pads a pair of resilient spring wire arm means mounting said pads spaced from said base for independent swinging movement of each pad relative to said base between a normal retracted position and an extended marking position, and means hingedly supporting the resilient arm means on the base with the pads in upward retracted positions, each of said arm means comprising a resiliently flexible arm which bends in response to light manual downward pressure on said marking pad into an extended downward marking position.

8. The marking attachment according to claim 7 wherein:

each pad includes means for placing on said stenotype tape a mark having a distinctive characteristic.

9. The marking attachment according to claim 8 wherein:

said marking pads comprise porous marking pads for containing marking fluid of different colors.

10. The marking attachment according to claim 7 wherein:

said arm means comprises a resiliently flexible arm mounting each marking pad.

11. A tape marking attachment for a stenotype machine comprising:

a mounting base for attachment to the machine, a pair of marking pads, a pair of resiliently flexible arm means mounting said pads spaced from said base for independent swinging movement of each pad relative to said base between a normal retracted position and an extended marking position, and means hingedly supporting the resilient arm means on the base with the pads in upward retracted positions, each of said arm means comprising a resiliently flexible arm which bends in response to manual downward pressure on said marking pad into an extended downward marking position, each flexible arm comprising a wire.

12. The marking structure according to claim 7 wherein:

said arm means comprises a hinge plate pivotally joined to said mounting base and a pair of resiliently flexible arms secured at one end to said hinge plate and at the opposite end to said mounting pads, said hinge plate, flexible arms, and mounting pads comprise a marking structure which is rotatable relative to said mounting base between operative and inoperative positions, and each marking pad is movable between its normal retracted position and extended marking position by bending of the respective flexible arm relative to said hinge plate when said marking structure occupies said operative position.

13. A tape marking attachment for a stenotype machine comprising:

a mounting base for attachment to the machine, a pair of marking pads, resilient arm means mounting said pads on said base for independent swinging movement of each pad relative to said base between a normal retracted position and an extended marking position, said arm means comprising a generally U-shaped spring wire including a pair of generally parallel spring arms integrally joined at one end by a transverse connecting portion, a hinge plate pivotally joined along one edge to said mounting base and having a recess entering one side of said hinge plate and receiving the U portion of said wire with said connecting wire portion and said spring arm ends engaging within channels about three sides of said recess to secure said wire to said hinge plate and with said spring arms extending beyond the opposite edge of said hinge plate, and said marking pads are mounted on the opposite ends of said spring arms.

14. The marking attachment according to claim 13 wherein:

said attachment comprises hollow holders secured to said spring arms and containing normally downwardly opening cavities receiving said marking pads with said pads projecting below said holder for contact with said stenotype tape, and said holders have normally upper surfaces against which finger pressure may be exerted to depress said marking pads from their normal extracted positions to their extended marking positions.

15. The marking attachment according to claim 14 wherein:

said marking pads have normally lower tape engaging surfaces which incline upwardly laterally of said arms toward a normally vertical plane between and parallel to said arms.

16. The marking attachment according to claim 13 wherein:

said mounting base comprising a mounting plate, said hinge plate, wire, holders, and marking pads comprise a marking structure which is rotatable relative to said mounting plate between operative and inoperative positions, said hinge plate overlies said mounting plate in said operative position, resilient cushion means on one of said plates for supporting said hinge plate in said operative position relative to said base plate, and said spring arms are flexible relative to said hinge plate in said operative position of said marking structure to accommodate depression of said marking pads from their normal inoperative positions to their marking positions.

17. In combination:

a stenotype machine including a housing having a rear opening past which a stenotype tape is fed, tape marking means including a marking pad, and resilient spring wire arm means mounting said pad on said housing for swinging movement of said pad between a normal retracted position spaced from the path of said tape and into an extended tape marking position within said path, and means hingedly supporting the resilient wire arm means on the base with the pad in an upward retracted position, said arm means comprising a resiliently flexible arm which bends in response to light manual downward pressure on said marking pad into an extended downward marking position.

18. The combination according to claim 17 wherein:

said means comprises a hinge plate pivotally attached to said housing, and said arm means comprises a resiliently flexible arm secured to said hinge plate and to said marking pad to form with said hinge plate and marking pad a marking structure which is rotatable relative to said housing between an operative position adjacent said opening and an inoperative position remote from said opening, and said arm is flexible relative to said hinge plate for depression of said marking pad from its normal retracted position to its extended tape marking position by bending of said arm when said marking structure occupies said operative position.

19. In combination:

a stenotype machine including a housing having a rear opening past which the stenotype tape is fed, tape marking means on said housing including a pair of marking pads, and resilient spring wire arm means mounting said pads on said housing for independent swinging movement of each pad between a normal retracted position spaced from the path of said tape and extended marking position in said path, and means hingedly supporting the resilient arm means on the base with the pads in upward retracted positions, each of said arm means comprising a resiliently flexible arm which bends in response to light manual downward pressure on said marking pad into an extended downward marking position.

20. The combination according to claim 19 wherein:

said pads are disposed to mark opposite longitudinal edges of said tape.

21. The combination according to claim 19 wherein:

said arm means comprises a hinge plate pivotally attached to said housing and said resilient arm means comprises a pair of spring arms secured to said hinge plate and to said mounting pads to form with said hinge plate and mounting pads a marking structure which is rotatable relative to said housing between a normal operative position adjacent said opening and an inoperative position remote from said opening, and said spring arms are flexible relative to said mounting plate for depression of said marking pads from their normal retracted positions to their extended tape marking positions by bending of said arms relative to said hinge plate when said marking structure occupies said operative position.

* * * * *